US006203169B1

(12) United States Patent
Coushaine et al.

(10) Patent No.: US 6,203,169 B1
(45) Date of Patent: Mar. 20, 2001

(54) LAMP AND METHOD OF PRODUCING SAME

(75) Inventors: Charles M. Coushaine, Rindge; Edward P. Otto, Henniker, both of NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/340,175

(22) Filed: Jun. 25, 1999

(51) Int. Cl.[7] ..... H01J 5/48

(52) U.S. Cl. ..... 362/226; 362/457; 313/318.01; 313/318.1

(58) Field of Search ..... 362/226, 457, 362/396, 288; 313/318.1, 318.01

(56) References Cited

U.S. PATENT DOCUMENTS 4,473,770 * 9/1984 Baba et al. ..... 362/267
4,890,202 * 12/1989 Blanche ..... 362/226
5,229,683 * 7/1993 Eckhardt et al. ..... 362/226
5,239,226 * 8/1993 Seredich et al. ..... 362/226
5,627,428 5/1997 Helbig ..... 313/318

FOREIGN PATENT DOCUMENTS 0 321 866 6/1989 (EP) .

* cited by examiner

*Primary Examiner*—Thomas M. Sember
(74) *Attorney, Agent, or Firm*—William E. Meyer

(57) ABSTRACT

A lamp assembly is provided which includes a lamp such as an arc tube sealed within a sleeve which is attached to a pair of retainer members which are coupled to a base component. The sleeve includes a circumferential groove and the retainer members include curved detents. The retainer members are attached to the sleeve by causing the detents to engage the surface of the groove and mate therewith, the two retainer members being welded together. Respective segments of the retainer members are tensioned relative to a mounting portion of the base component and attached thereto.

14 Claims, 6 Drawing Sheets

LAMP AND METHOD OF PRODUCING SAME

TECHNICAL FIELD

The present invention relates to a lamp assembly, and more particularly, to a lamp assembly which includes retainer members by which a lamp sleeve is supported relative to a lamp base. The retainer members are firmly attached to the sleeve and provides 3-axis lamp focus before being firmly attached to the base. A method of producing such a lamp assembly is also provided.

BACKGROUND ART

It is known to provide a lamp assembly which generally includes a lamp coupled to a lamp sleeve which is coupled to a lamp base by a retainer member. It is known to provide a high intensity discharge (HID) lamp in this manner. The conventional sleeve used with such an HID lamp is typically fabricated from glass and is generally cylindrical in configuration. Typically, the sleeve is attached to the lamp base by engaging an outer surface of the sleeve with a retainer member which is coupled to the lamp base. One concern regarding such structure is that although the outer peripheral surface of the sleeve is round, it is often not consistently round enough to provide a surface which can be satisfactorily held in place by the retainer member. In addition, any imperfections, such as scratches and nicks in the glass which are proximate to the retainer member have a tendency to propagate cracks during lamp assembly, and this ultimately causes lamp failure. In some instances the lamp may even explode. If the glass sleeve is replaced with a plastic sleeve, it will be necessary for thermal reasons to limit the lamp wattage. In one known HID lamp, the retainer member is molded from plastic, and this also tends to limit the temperature capability of the lamp. In addition, processing of such plastic retainer member requires that the retainer member and the base be fabricated by metal insert molding. Further, it is necessary for three parts to be insert molded into such lamp base. An example of such a prior art lamp assembly is illustrated in FIG. 1. In this embodiment a lamp sleeve 2 is held in place by a molded plastic retainer member 4 which is attached to a molded plastic base 6. The retainer member 4 and base 6 contain a plurality of metal inserts 8 which must be provided by metal insert molding. Such a process is difficult and costly.

DISCLOSURE OF THE INVENTION

It is an object of the present invention to provide an improved lamp assembly.

Another object of the present invention is to provide a lamp assembly which obviates the disadvantages of the prior art.

A further object of the present invention is to provide an improved and cost efficient lamp assembly.

Yet another object of the present invention is to provide a lamp assembly having a sleeve and retainer arrangement which provides improved support for the sleeve.

Another object of the present invention is to provide a lamp assembly having improved thermal capability.

A further object of the present invention is to provide a lamp assembly wherein fabrication thereof includes simplified molding of the base and no molding of the sleeve retainer member.

Yet another object of the present invention is to provide a method of producing the lamp assembly of the present invention.

The present invention achieves these and other objects by providing a lamp assembly comprising a sleeve extending in the direction of a longitudinal axis from a first sleeve end to an opposite second sleeve end. An outer surface of the sleeve comprises at least one groove which extends in a plane which is transverse to the longitudinal axis and is located between the first sleeve end and the second sleeve end. A base component is provided having a mounting portion and comprising contacts structured and arranged for connection with a connector. A lamp is provided which extends in the sleeve and comprises lead wires coupled to the contacts. A pair of retainer members is provided each of which extends from a first end segment to an opposite second end segment. The groove is disposed between, and mated with, the first end segments. The second end segments are structured and arranged to be (a) tensioned relative to the mounting portion in a first mode, and (b) fixed to the mounting portion in a second mode.

A method of producing a lamp assembly of the present invention is also provided. Such method comprises the steps of forming at least one circumferential groove in an outer surface of a lamp sleeve so that the groove extends in a plane which is transverse to a longitudinal axis of the lamp sleeve; affixing a lamp internal of the lamp sleeve; forming a base component having a mounting portion; shaping a first end segment of respective first and second retainer members so as to be engagable and matable with the groove; shaping a second end segment of the respective first and second retainer members so as to be tensioned relative to the mounting portion when the first and second retainer members are coupled to the mounting portion; attaching the first and second retainer members to the sleeve such that each first end segment contacts and mates with the groove; coupling the first and second retainer members to the base component; focusing the lamp relative to the base component by moving the retainer members relative to the mounting portion until the lamp is focused; and fastening each second end segment to the mounting portion.

BRIEF DESCRIPTION OF THE DRAWINGS

This invention may be clearly understood by reference to the attached drawings in which like reference numerals designate like parts and in which.

MODE FOR CARRYING OUT THE INVENTION

Figure 1:
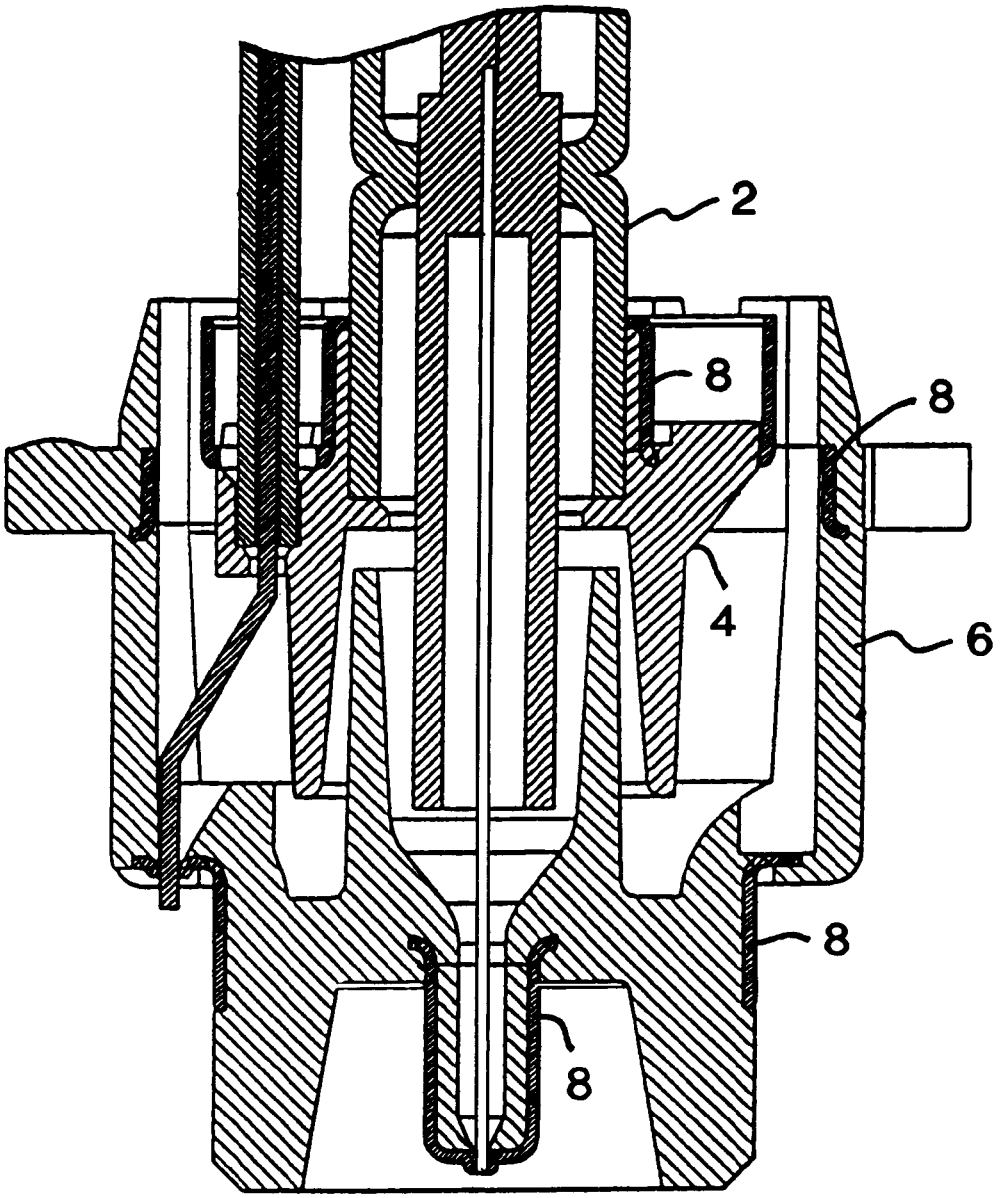
FIG. 1 PRIOR ART
FIG. 1 is a view of a prior art lamp assembly.
Figure 2:
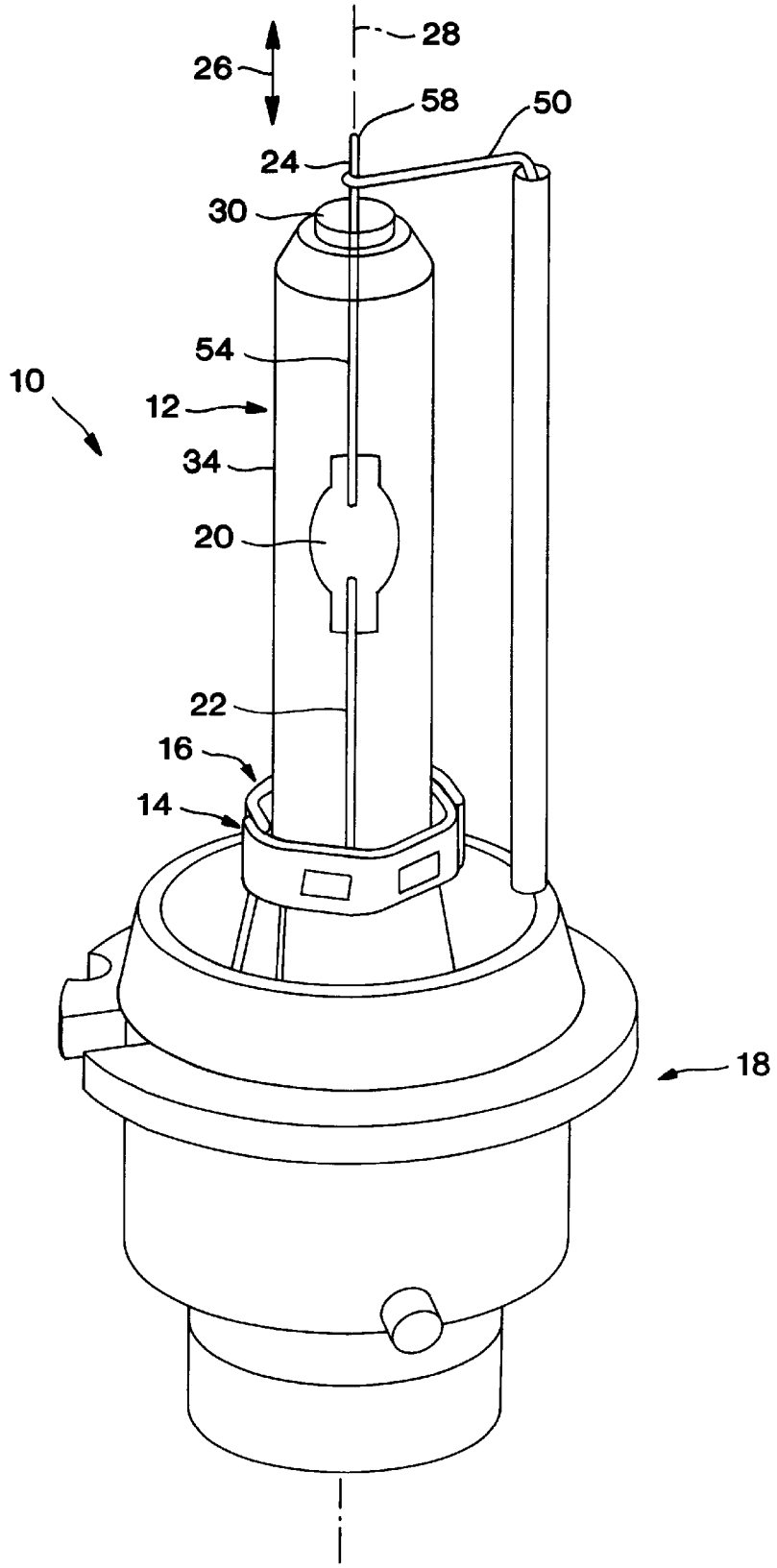
FIG. 2 is a perspective view of one embodiment of the lamp assembly of the present invention.
Figure 3:
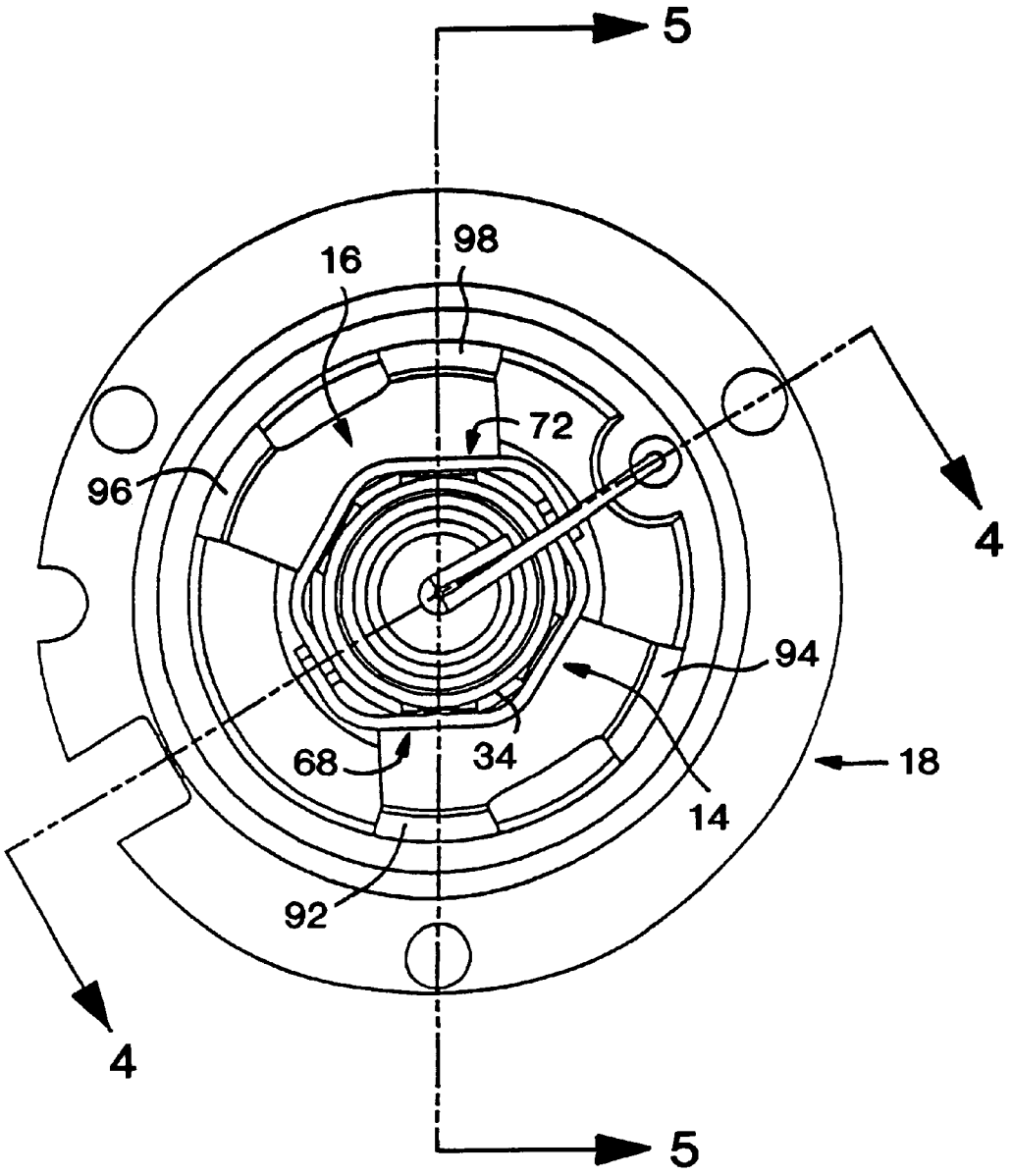
FIG. 3 is a top view of the lamp assembly of FIG. 2.

For a better understanding of the present invention, together with other and further objects, advantages and capabilities thereof, reference is made to the following disclosure and appended claims taken in conjunction with the above-described drawings.

The lamp base assembly of the present invention comprises a sleeve attached to a pair of retainer members which are attached to a base component having contacts adapted to be connected to a connector in a conventional manner. A lamp is positioned within the sleeve and includes lead wires coupled to the contacts. The sleeve includes a groove which is shaped in such a manner that it matches the pair of retainer members between which the sleeve is supported. The pair of retainer members is adapted (a) to be tensioned relative to the base component in a first mode during which the lamp may be oriented relative to the base component by being slid in or out, and titled back and forth or right and left in the direction of Z-, X- or Y-axes, respectively, to position the lamp as desired, and (b) to be fixed to the base component in a second mode to hold the lamp in place in such desired position. FIGS. 2 to 5 illustrate one embodiment of such a lamp assembly.

With reference to FIGS. 2 to 5, a lamp assembly 10 is provided which includes a glass sleeve 12 attached to a pair of retainer members including a first retainer member 14 and a second retainer member 16. Without limitation, the lamp assembly 10 is an HID lamp assembly which may be used in a conventional HID automotive headlamp. The retainer members 14 and 16 are attached to a base component 18. A lamp 20 is positioned within the sleeve 12 and includes lead wires 22 and 24 which are coupled to base component contacts as described herein. The sleeve extends in the direction 26 of a longitudinal axis 28 from a closed first sleeve end 30 to an opposite open second sleeve end 32.

The sleeve of the present invention includes an outer surface comprising at least one groove which extends in a plane which is transverse to the longitudinal axis of the sleeve and is located between the sleeve ends. For example, in the embodiment illustrated in FIGS. 2 to 5, the sleeve 12 is generally cylindrical and includes an outer surface 34 comprising a single circumferential groove 36 which extends 360° about the longitudinal axis 28. The groove 36 extends in a plane identified in FIGS. 4 and 5 by line 38 which is transverse to axis 28 and is located between the closed sleeve end 30 and the open sleeve end 32. In a preferred embodiment, the sleeve 12 comprises a precisely roll-formed groove 36 in the outer surface 34. For example, groove 36 may be formed by coupling the sleeve 12 to a lathe, heating the sleeve by positioning a flame adjacent the surface area where the groove is to be provided, and engaging such heated surface area with a precisely positioned wheel or roller. The wheel is rolled in the heated sleeve material to form the circumferential groove 36. In this manner, a glass sleeve having a consistent, known contact surface area may be provided having no imperfections such as scratches or nicks. The sleeve 12 comprises an inner surface 40 which comprises a lamp sealing portion 42 which extends 360° about longitudinal axis 28 in plane 38.

The lamp 20 may be a conventional light source such as an arc tube. The lamp 20 is affixed within the surrounding sleeve 12. In particular, the lamp 20 extends in the sleeve 12 and is sealed therein in a conventional manner where an outer surface 44 of the lamp abuts the lamp sealing portion 42. The lead wire 22 of the lamp 20 is coupled to contact 46 of the base component 18 in a conventional manner. The lead wire 24 is coupled to the contact 48 through a conductor 50, in a conventional manner. The lead wires 22 and 24 extend in the direction 26 of longitudinal axis 28. The lead wires 22 and 24 are substantially straight and extend from respective first ends 52 and 54 within the lamp 20 to respective second ends 56 and 58 outside of the sleeve 12.

The base component of the present invention comprises a mounting portion to which the retainer members of the present invention are attached as described herein. In the embodiment illustrated in FIGS. 2 to 5 a plastic base component 18 is provided which comprises an inner sleeve 60 having an outer surface 62 and an outer sleeve 64 having an inner surface 66. The inner sleeve 60 is disposed concentric relative to the outer sleeve 64, and both sleeves extend in the direction 26 of longitudinal axis 28. In the embodiment illustrated in FIGS. 2 to 5 the base component 18 is a molded non-conductive plastic unit having only two metal insert molded components in the form of contacts 46 and 48.

Figure 4:
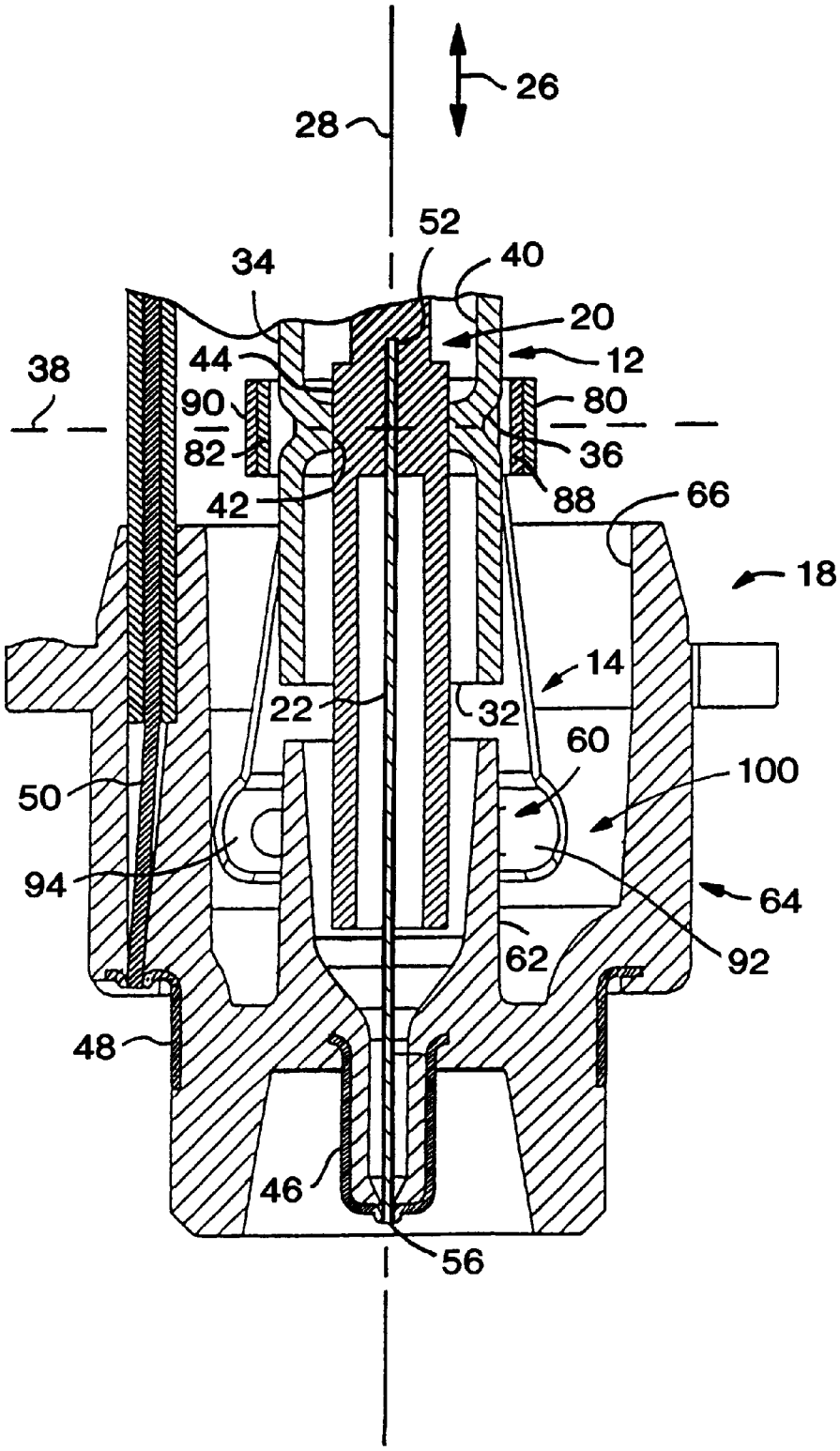
FIG. 4 is a sectional view of FIG. 3 taken along lines 4—4.
Figure 5:
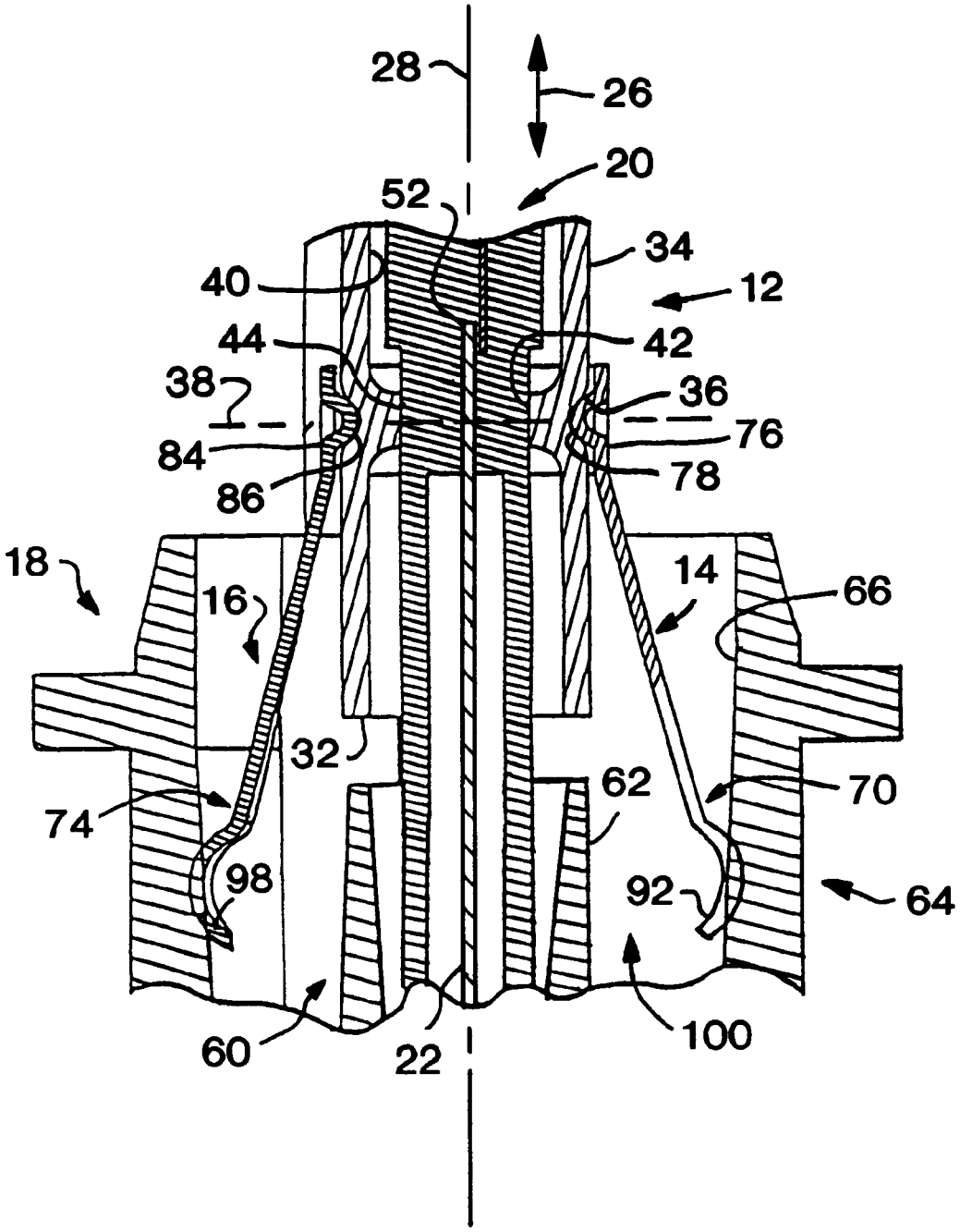
FIG. 5 is a sectional view of FIG. 3 taken along lines 5—5.
Figure 6:
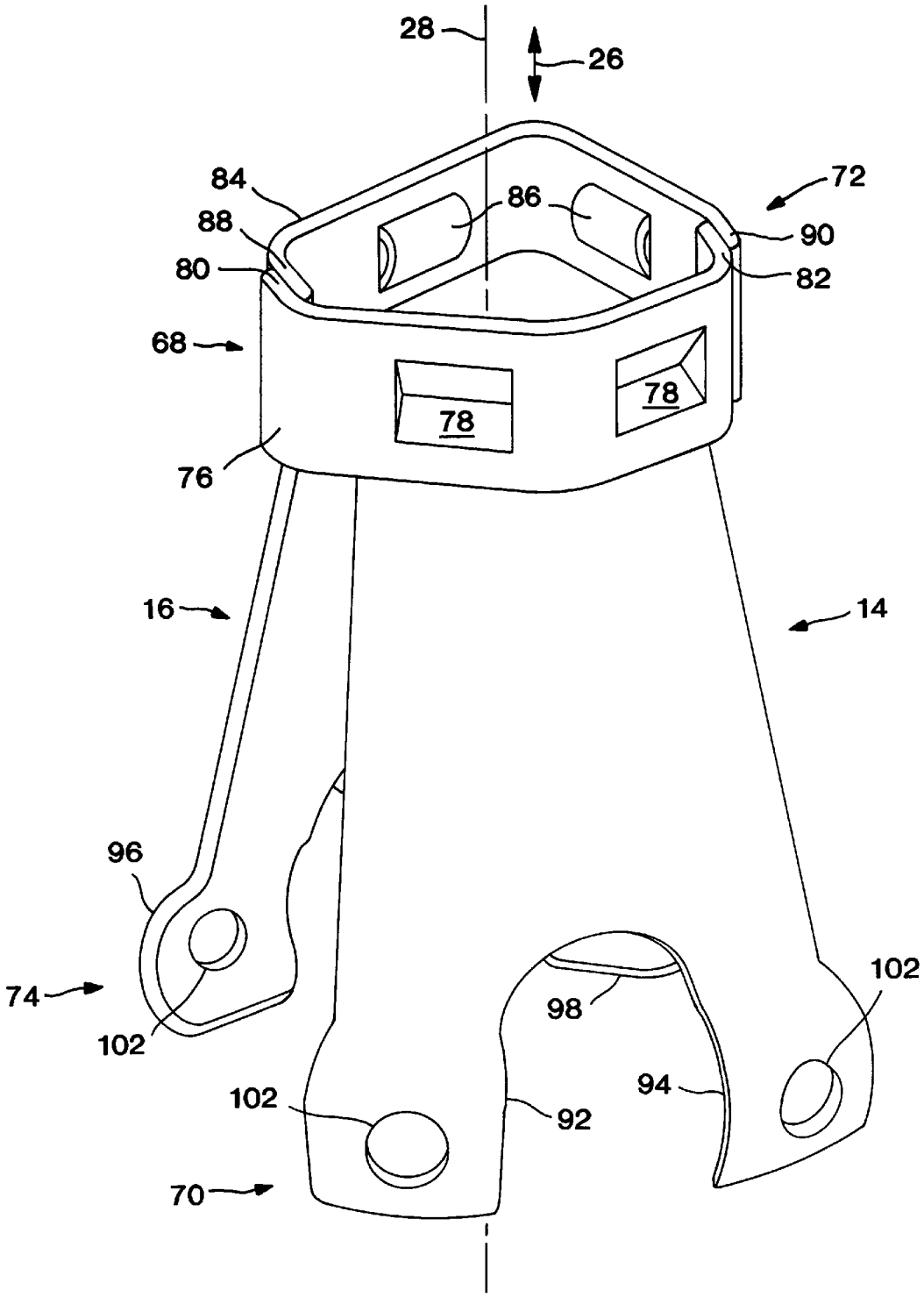
FIG. 6 is a perspective view of one embodiment of the retainer members of the present invention.

Each retainer member of the present invention extends from a first end segment to an opposite second end segment. Each retainer member may be formed from metal by a conventional stamping operation. The use of metal increases the temperature capability of the lamp assembly allowing for the use of higher wattage lamps. In the embodiment illustrated in the drawings, the retainer members are identical. The retainer members are structured and arranged such that (a) the first end segments engage and mate with the groove extending into the outer surface of the sleeve, and (b) the second end segments are resilient so that they may be tensioned relative to the mounting portion of the base component in a first mode. The second end segments are fixed to the mounting portion in a second mode. For example, in the embodiment illustrated in FIG. 6, the retainer member 14 extends from an end segment 68 to an opposite end segment 70, and the retainer member 16 extends from an end segment 72 to an opposite end segment 74. The groove 36 in the outer surface 34 of the sleeve 12 is disposed between and mates with the end segments 68 and 72 of respective retainer members 14 and 16. To this end, the segments 68 and 72 each comprises a band having opposite ends, the opposite ends of one band overlapping with and being attached to respective opposite ends of the other band. For example, the end segment 68 of the retainer member 14 comprises a generally U-shaped band 76 shaped to comprise two indents 78, curved convex towards axis 28, and a first leg 80 and a second leg 82. Similarly, the end segment 72 of the retainer member 16 comprises a generally U-shaped band 84 shaped to comprise two identical indents 86, curved convex towards axis 28, and a first leg 88 and a second leg 90. In the embodiment illustrated in the drawings, the roll formed groove 36 and detents 78, 86 are configured such that the surface of the groove contacts and matches or mates with the detents when the device is assembled. The legs 80 and 82 overlap with and are attached to respective legs 88 and 90 as, for example, by laser welding. With reference to FIGS. 4 and 5, a portion of the sleeve 12 is disposed between the opposing U-shaped bands 76 and 84, and the detents 78 and 86 are disposed within and mate with the groove 36. When attaching the retainer members 14 and 16 to the sleeve 12, the detents 78 and 86 are fitted into the groove 36 with the ends of band legs 80 and 82 overlapping respective ends of legs 88 and 90. The retainer members 14 and 16 are then pushed together to a set force, and the respective ends are laser welded together thereby locking the detents 78 and 86 in the groove 36.

The end segments 70 and 74 of respective retainer members 14 and 16 are resilient so that they may be tensioned relative to a mounting portion of the base component 18 in a first mode. To this end, the end segment 70 comprises curved skirts 92 and 94, and the end segment 74 comprises curved skirts 96 and 98. Each skirt 92, 94, 96 and 98 is concave relative to axis 28. In the embodiment of the present invention illustrated in the drawings, the inner surface 66 of the sleeve 64 of base component 18 serves as a mounting portion of the base component. With reference to FIGS. 4 and 5, the skirts 92, 94, 96 and 98 are structured and arranged to engage and be biased against the inner surface 66 when the sleeve 12 has been attached to the retainer members 14 and 16 as described above, and the retainer members are inserted into the annular opening 100 between surfaces 62 and 66. In this manner, the skirts 92, 94, 96 and 98 engage and are tensioned relative to a mounting portion of the base component 18 by being expanded away from the longitudinal axis 28 sufficiently to be biased against surface 66 to couple the retainer members to the mounting portion when inserted into opening 100, in a first mode. In an alternative embodiment, the outer surface 62 of the sleeve 60 of the base component 18 may serve as the mounting portion of the base component. In such an embodiment, the skirts 92, 94, 96 and 98 engage and are tensioned relative to a mounting portion of the base component 18 by being compressed towards the longitudinal axis 28 sufficiently to be biased against the outer surface 62 to couple the retainer members to the mounting portion when inserted into opening 100, in a first mode.

Regardless of the manner in which the second end segments of the retainer members are tensioned relative to a mounting portion of the base component, once the second end segments have engaged, and are tensioned relative to, the mounting portion in a first mode, the lamp may be focused using a three axis motion. In particular, the retainer members, the sleeve supported thereby, and the lamp supported within the sleeve, may be oriented as a unit relative to the base component by being slid in the direction of a Z-axis, and tilted back and forth in the direction of an X-axis and left and right in the direction of a Y-axis, to the extent required to properly focus the lamp. For example, in the embodiment illustrated in the drawings, the unit comprising the sleeve 12, retainer members 14, 16 and lamp 20 may be oriented relative to the base component 18 by sliding the skirts 92, 94, 96 and 98 relative to surface 66 in a Z-direction identified by the direction 26 of axis 28, and tilting or otherwise pivoting the skirts relative to surface 66 back and forth and right and left in the direction of any X-axis and any Y-axis relative to axis 28. In this manner, three axis focusing of lamp 20 is provided while maintaining contact between the retainer members 14 and 16 and the base component 18.

When the lamp is properly focused, the focused lamp may be held in place by fixing the retainer members to the base component, in a second mode. To this end, the second end segments of the retainer members may be melt fused to the base component thereby fixing in place the unit formed by the sleeve, resilient members and lamp. For example, as illustrated in FIG. 5, the end segments 70 and 74 may be attached to the base component 18 by melt fusing the respective skirts 92, 94, 96 and 98 to the sleeve 64 at the mounting portion of the base component formed by the inner surface 66, in a conventional manner such as by heating using radio frequency heat. To facilitate affixation, the skirts 92, 94, 96 and 98 may each comprise at least one aperture 102. In this manner, during melt fusing portions of the melted base component 18 will flow through respective apertures 102 to improve the attachment of the skirts 92, 94, 96 and 98 to the surface 66.

The lamp assembly of the present invention is much simpler, less expensive and easier to assemble than previous designs yet functions at least just as well. For example, in addition to the improved characteristics described above, molding of the plastic base is simplified, and no molding is required of the retainer members. There are less components required than heretofore, and the extent of insert molding is reduced. The retainer members may be identical, and each may be stamped from a single piece of metal. Production of the components and the assembled device is very repeatable. The lamp assembly is very robust, the mating groove 36 and retainer members 14, 16 firmly and safely coupling the sleeve 12 to the retainer members. Another advantage is that the focusing pivot points provided by the skirts 92, 94, 96 and 98 are positioned relatively low within the base component 18. As a result, the lamp electrodes will rotate in a larger arc during focusing and therefor stay straighter.

The embodiments which have been described herein are but some of several which utilize this invention and are set forth here by way of illustration but not of limitation.

It is apparent that many other embodiments which will be readily apparent to those skilled in the art may be made without departing materially from the spirit and scope of this invention.

We claim:

1. A lamp assembly comprising: a sleeve having a first sleeve end and an opposite second sleeve end, defining a longitudinal axis therebetween, an outer surface of said sleeve including at least one groove which extends in a plane which is transverse to said longitudinal axis and is located between said first sleeve end and said second sleeve end;

a base component having a mounting portion and including contacts structured and arranged for connection with a connector;

a lamp extending in said sleeve and including lead wires coupled to said contacts; and a pair of retainer members each extending from a first end segment to an opposite second end segment, said groove being disposed between, and mated with, said first end segments, said second end segments being structured and arranged to be (a) tensioned relative to said mounting portion in a first mode, and (b) fixed to said mounting portion in a second mode, and wherein said sleeve is cylindrical, and further wherein said at least one groove is a single groove extending 360° about said axis.

2. The lamp assembly of claim 1 wherein each first segment comprises a band having opposite ends, said opposite ends of one first segment overlapping with and being attached to said opposite ends of the other first segment.

3. The lamp assembly of claim 2 wherein each band comprises two indents curved convex relative to said axis, each indent mating with said groove.

4. The lamp assembly of claim 3 wherein each second end segment comprises at least one skirt curved relative to said axis and tensioned relative to said mounting portion in said first mode.

5. The lamp assembly of claim 4 further wherein said skirts are tensioned relative to said mounting portion and engage said mounting portion by being one of compressed towards said longitudinal axis and expanded away from said longitudinal axis.

6. A lamp assembly, comprising:

a sleeve extending in the direction of a longitudinal axis from a closed first sleeve end to an opposite open second sleeve end, an inner surface of said sleeve including a lamp sealing portion extending in a plane which is transverse to said longitudinal axis and is located between said first sleeve end and said second sleeve end, and an outer surface of said sleeve including a groove extending in said plane;

a base component having a mounting portion and including contacts structured and arranged for connection to a connector;

a lamp extending in said sleeve, being sealed therein at said lamp sealing portion, and including lead wires coupled to said contacts; and a first retainer member extending from a first end segment to an opposite second end segment, and a second retainer member extending from a third end segment to an opposite fourth end segment said groove being disposed between and matins with said first and said third end segments, said first and said third end se2ments being attached to each other, said second and said fourth end segments being tensioned relative to said mounting portion in a first mode and being fixed to said mounting portion in a second mode, and wherein said first end segment comprises a first U-shaped band including at least one first indent, curved towards said axis, and having a first leg and a second leg, and said third end segment comprises a second U-shaped band including at least one second indent, curved towards said axis, and having a third leg and a fourth leg, said first leg overlapping and attached to said third leg, and said second leg overlapping and attached to said fourth leg, and further wherein a portion of said sleeve is disposed between said first and second U-shaped bands and said first and second indents are disposed within and mate with said groove.

7. The lamp assembly of claim 6 wherein said second and said fourth end segments each comprise at least one skirt which is curved relative to said axis.

8. the lamp assembly of claim 7 wherein said base component comprises an inner sleeve disposed concentric relative to an outer sleeve, said inner sleeve including an outer surface and said outer sleeve including an inner surface, said at least one curved skirt being tensioned relative to, in said first mode, one of said inner surface and said outer surface, and being fixed to one of said outer sleeve and said inner sleeve, respectively, in said second mode.

9. The lamp assembly of claim 8 wherein said lead wires comprise a first lead wire and a second lead wire each of which is substantially straight from one end to the other and extends in said direction of said longitudinal axis.

10. A method of producing a lamp assembly, comprising the steps of:

forming at least one circumferential groove in an outer surface of a lamp sleeve, said at least one groove extending in a plane which is transverse to a longitudinal axis of said lamp sleeve;

affixing a lamp internal of said lamp sleeve;

forming a base component having a mounting portion;

shaping a first end segment of respective first and second retainer members so as to be engageable and mateable with said at least one groove;

shaping a second end segment of said respective first and second retainer members so as to be tensioned relative to said mounting portion when said first and second retainer members are coupled to said mounting portion;

attaching said first and second retainer members to said sleeve such that each first end segment contacts and mates with said groove;

coupling said first and second retainer members to said base component;

focusing said lamp relative to said base component by moving said retainer members relative to said mounting portion until said lamp is focused; and fastening each second end segment to said mounting portion, and wherein said sleeve is glass and further wherein forming said at least one circumferential groove comprises circumferentially heating an outer surface of said glass sleeve and circumferentially roller forming a single groove extending 360° about said axis.

11. The method of claim 10 wherein said first and second retainer members comprise metal, wherein said shaping said first end segment comprises stamping respective curved detonates in said first end segments, said detents being engagaeable and mateable with said groove, and further wherein shaping said second end segment comprises stamping respective skirts in said second end segments, said skirts being tensioned relative to said mounting portion during said coupling step.

12. The method of claim 11 wherein said stamping comprises stamping identical first and second retainer members.

13. The method of claim 11 wherein said attaching comprises (a) pushing said first end segments together at a set force such that said detents engage and mate with a surface of said groove and ends of said first end segment of said first retainer member overlap respective ends of said first end segment of said second retainer member, and (b) welding said overlapping ends.

14. The method of claim 13 wherein said base component comprises an inner sleeve disposed concentric relative to an outer sleeve, and further wherein said coupling comprises one of compressing said skirts against said inner sleeve and expanding said skirts against said outer sleeve.

* * * * *